US009936553B2

(12) United States Patent
De Wilde

(10) Patent No.: US 9,936,553 B2
(45) Date of Patent: Apr. 3, 2018

(54) CONTROLLING AND CODING LIGHT, USING TRANSFER FUNCTION OF LIGHT SOURCE-DRIVER

(71) Applicant: PHILIPS LIGHTING HOLDING B.V., Eindhoven (NL)

(72) Inventor: Erik De Wilde, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/021,717

(22) PCT Filed: Sep. 1, 2014

(86) PCT No.: PCT/EP2014/068462
§ 371 (c)(1),
(2) Date: Mar. 14, 2016

(87) PCT Pub. No.: WO2015/036268
PCT Pub. Date: Mar. 19, 2015

(65) Prior Publication Data

US 2016/0234905 A1 Aug. 11, 2016

(30) Foreign Application Priority Data

Sep. 13, 2013 (EP) ..... 13184237

(51) Int. Cl.
*H05B 37/02* (2006.01)
*H05B 33/08* (2006.01)

(52) U.S. Cl.
CPC ..... *H05B 33/0851* (2013.01); *H05B 33/0815* (2013.01); *H05B 33/0839* (2013.01); *H05B 33/0845* (2013.01)

(58) Field of Classification Search
CPC ..... H05B 33/0815; H05B 33/0839; H05B 33/0845

(Continued)

(56) References Cited

U.S. PATENT DOCUMENTS 6,388,396 B1 5/2002 Katyl et al.
2003/0030386 A1 * 2/2003 Leeb ..... H04B 10/1143 315/291

(Continued)

FOREIGN PATENT DOCUMENTS

WO WO2009019655 2/2009
WO WO20110640077 6/2011
WO WO2013068866 5/2013

OTHER PUBLICATIONS

D'Azzo, John J., "Linear Control System Analysis and Design", Dec. 31, 1981, Kogakusha Ltd., Tokyo, Japan, pp. 35-36, XP002732975.

(Continued)

*Primary Examiner* — Thuy Vinh Tran
(74) *Attorney, Agent, or Firm* — Akarsh P. Belagodu

(57) ABSTRACT

A controller for controlling a generator arranged to the generate a frequency signal for controlling a converter in a driver for driving a light circuit, the controller receiving feed-back information from the light circuit, and a processor; the processor configured to produce, in response to the feed-back information from the light circuit, a control signal arranged to control the generator, the feed-back information comprising a value of a feed-back signal that flows through at least a part of the light circuit or that defines a light intensity of at least a part of the light circuit, and the control signal defining a frequency of the frequency signal, adapt, in response to data information, the control signal, wherein the data information comprises a code for coding light produced by the light circuit; determine a static transfer of a combination of the converter and the light circuit defined by values of the feed-back signal and corresponding values of the frequency of the frequency signal; divide the values of the (Continued)

feed-back signal into intervals of a substantially equal size; and adapt the control signal in interval steps.

10 Claims, 3 Drawing Sheets

(58) Field of Classification Search
USPC ..... 315/291, 308
See application file for complete search history.

(56) References Cited

U.S. PATENT DOCUMENTS

| | | | | |
|---|---|---|---|---|
| 2003/0111533 | A1 | 6/2003 | Chang | |
| 2009/0160833 | A1 | 6/2009 | Brown et al. | |
| 2010/0001659 | A1 | 1/2010 | Inoue | |
| 2010/0213856 | A1* | 8/2010 | Mizusako | H02M 1/36 315/158 |
| 2010/0327755 | A1* | 12/2010 | Meijer | H05B 33/0818 315/152 |
| 2013/0229119 | A1 | 9/2013 | Korobov et al. | |

OTHER PUBLICATIONS

Ogata, Katushiko, "Modern Control Engineering", Dec. 31, 2002, Prentice Hall, United States of America, pp. 58-59, XP00273977.

* cited by examiner

CONTROLLING AND CODING LIGHT, USING TRANSFER FUNCTION OF LIGHT SOURCE-DRIVER

CROSS-REFERENCE TO PRIOR APPLICATIONS

This application is the U.S. National Phase application under 35 U.S.C. § 371 of International Application No. PCT/EP2014/068462, filed on Sep. 1, 2014, which claims the benefit of European Patent Application No. 13184237.9, filed Sep. 13, 2013. These applications are hereby incorporated by reference herein.

FIELD OF THE INVENTION

The invention relates to a controller for controlling a generator arranged to generate a frequency signal for controlling a converter in a driver for driving a light circuit. The invention further relates to a converter comprising the controller, to a driver comprising the converter, to a light circuit comprising the controller or the converter or the driver, to a method for controlling a generator arranged to generate a frequency signal for controlling a converter in a driver for driving a light circuit, to a computer program product and to a medium.

Examples of such a converter are resonant converters. Examples of such a light circuit are circuits comprising one or more light emitting diodes of whatever kind and in whatever combination.

BACKGROUND OF THE INVENTION

A controller for controlling a generator arranged to generate a frequency signal for controlling a converter in a driver for driving a light circuit is of common general knowledge. The generator is controlled in response to feed-back information from the light circuit to regulate a light intensity of the light from the light circuit and/or to compensate for fluctuations of the light intensity.

Sometimes the light intensity of the light from the light circuit needs to be coded for information purposes and/or for communication purposes. This can be done by manipulating the feed-back information. In that case, the controller will need to have a relatively large processing capacity.

US 2010/0327755 A1 discloses a color controlled light source with a color control unit and with an external modulator and an external demodulator.

SUMMARY OF THE INVENTION

It is an object of the invention to provide an improved controller. Further objects of the invention are to provide a converter, a driver, a light circuit, an improved method, a computer program product and a medium.

According to a first aspect, a controller is provided for controlling a generator arranged to generate a frequency signal for controlling a converter in a driver for driving a light circuit, the controller comprising:

a first part for in response to feed-back information from the light circuit producing a control signal arranged to control the generator, the feed-back information comprising a value of a feed-back signal that flows through at least a part of the light circuit or that defines a light intensity of at least a part of the light circuit, and the control signal defining a frequency of the frequency signal, a second part for in response to data information adapting the control signal, the data information comprising a code for coding light produced by the light circuit, and a third part for determining a static transfer of a combination of the converter and the light circuit defined by values of the feed-back signal and corresponding values of the frequency of the frequency signal.

A controller controls a generator such as for example an actuator etc. The actuator produces a frequency signal such as for example a square wave having a varying frequency etc. The frequency signal controls a converter such as for example a resonant converter etc. such as for example a LLC converter or a LCL converter or a CLC converter etc. The converter produces a feeding signal for feeding a light circuit. The feeding signal depends on the frequency signal. A first part of the controller receives feed-back information from the light circuit and produces a control signal for controlling (the frequency signal generated by) the generator. This is for example done to regulate a light intensity of the light from the light circuit and/or to compensate for fluctuations of the light intensity.

A second part of the controller adapts the control signal in response to data information comprising a code for coding the light produced by the light circuit. By having introduced the second part, the feed-back information is only used for the purpose of regulation and/or compensation, and the control signal is adapted for the purpose of information and/or communication. As a result, the controller does no longer need to have a relatively large processing capacity. This is a great advantage and a great improvement.

The first part of the controller can be a hardware part such as a dedicated hardware part or a programmable hardware part etc. or can be a software part or can be a mixture of both. The second part of the controller can be a hardware part such as a dedicated hardware part or a programmable hardware part etc. or can be a software part or can be a mixture of both. The first and second parts of the controller can be separated parts or can be partly overlapping parts or can be a same part.

The feeding signal produced by the converter may preferably comprise a current signal flowing through at least a part of the light circuit for feeding the light circuit. This current signal may be used as a feed-back signal. Alternatively, a current signal or a voltage signal defining a light intensity of at least a part of the light circuit may be used as a feed-back signal. The control signal may preferably define a frequency of the frequency signal, whereby for example a higher (lower) frequency of the frequency signal will result in a smaller (larger) amplitude of the feeding signal.

A third part of the controller may determine a static transfer of a combination of the converter and the light circuit. The static transfer provides for a required value of the feed-back signal a corresponding value of the frequency of the frequency signal that will result in the feed-back signal getting the required value.

The third part of the controller can be a hardware part such as a dedicated hardware part or a programmable hardware part etc. or can be a software part or can be a mixture of both. The first, second and third parts of the controller can be separated parts or can be partly overlapping parts or can be a same part.

An embodiment of the controller is defined by the first part being arranged to compare the value of the feed-back signal with a reference value and to adapt the control signal in response to a comparison result. The value of the feed-back signal in the form of the current signal flowing through at least a part of the light circuit can be compared directly with a reference (current) value or can be compared indirectly by comparing a value of a voltage signal derived from the current signal with a reference (voltage) value. Similarly, the value of the feed-back signal in the form of the current signal or the voltage signal defining a light intensity of at least a part of the light circuit can be compared directly or indirectly with a reference value etc. In response to a comparison result, the control signal is to be adapted. This may be done in the analog domain or in the digital domain. The first part may adapt the control signal at the hand of the static transfer or not.

An embodiment of the controller is defined by the second part being arranged to adapt the control signal in response to the data information at the hand of the static transfer. The data information defines when the light intensity is to be changed. A modulation depth defines how much the light intensity is to be changed. The modulation depth is usually pre-stored in the controller. The static transfer provides, for a required value of the current signal, a corresponding value of the frequency of the frequency signal that will result in the current signal getting the required value. Therefore, the static transfer is highly suitable as a basis for adapting the control signal.

An embodiment of the controller is defined by the corresponding values of the frequency of the frequency signal being situated on a first axis, the values of the feed-back signal being situated on a second axis, the third part being arranged to divide the values of the feed-back signal into intervals of a substantially equal size. A first axis may for example be a x-axis, and a second axis may for example be a y-axis. A substantially equal size allows variations of at most 10%, preferably at most 5%, most preferably at most 1%.

An embodiment of the controller is defined by further comprising a fourth part for defining a default transfer of the combination of the converter and the light circuit. A default transfer allows the controller to be started without a (complete) static transfer being present.

The fourth part of the controller can be a hardware part such as a dedicated hardware part or a programmable hardware part etc. or can be a software part or can be a mixture of both. The first, second, third and fourth parts of the controller can be separated parts or can be partly overlapping parts or can be a same part.

An embodiment of the controller is defined by the controller being a self-learning-controller arranged to start with the default transfer and to create the static transfer in operation. A self-learning-controller can be used over and over again for different light circuits and in different environments.

According to a second aspect, a converter is provided comprising the controller as defined above and further comprising the generator.

According to a third aspect, a driver is provided comprising the converter as defined above.

An embodiment of the driver is defined by the generator comprising an actuator for producing the frequency signal in the form of a square wave having a varying frequency.

An embodiment of the driver is defined by the converter comprising a resonant converter for producing an output current signal destined for the light circuit.

An embodiment of the driver is defined by further comprising a power factor correction converter for receiving an input voltage signal and producing an output voltage signal destined for the resonant converter.

According to a fourth aspect, a light circuit is provided comprising the controller as defined above or comprising the converter as defined above or comprising the driver as defined above.

According to a fifth aspect, a method is provided for controlling a generator arranged to generate a frequency signal for controlling a converter in a driver for driving a light circuit, the method comprising:

a first step for in response to feed-back information from the light circuit producing a control signal arranged to control the generator, the feed-back information comprising a value of a feed-back signal that flows through at least a part of the light circuit or that defines a light intensity of at least a part of the light circuit, and the control signal defining a frequency of the frequency signal, a second step for in response to data information adapting the control signal, the data information comprising a code for coding light produced by the light circuit, and a third step for determining a static transfer of a combination of the converter and the light circuit defined by values of the feed-back signal and corresponding values of the frequency of the frequency signal.

According to a sixth aspect, a computer program product is provided for performing the steps of the method as defined above.

According to a seventh aspect, a medium is provided for storing and comprising the computer program product as defined above.

An insight is that feed-back information and feed-forward information should not be combined. A basic idea is that feed-back information is to be converted into a control signal and that feed-forward information is to be used for adapting the control signal.

A problem to provide an improved controller has been solved. A further advantage is that a non-linearity in a frequency-signal-to-feeding-signal-performance of a combination of a converter and a light circuit can be easily neutralized.

These and other aspects of the invention will be apparent from and elucidated with reference to the embodiments described hereinafter.

DETAILED DESCRIPTION OF EMBODIMENTS

Figure 1:
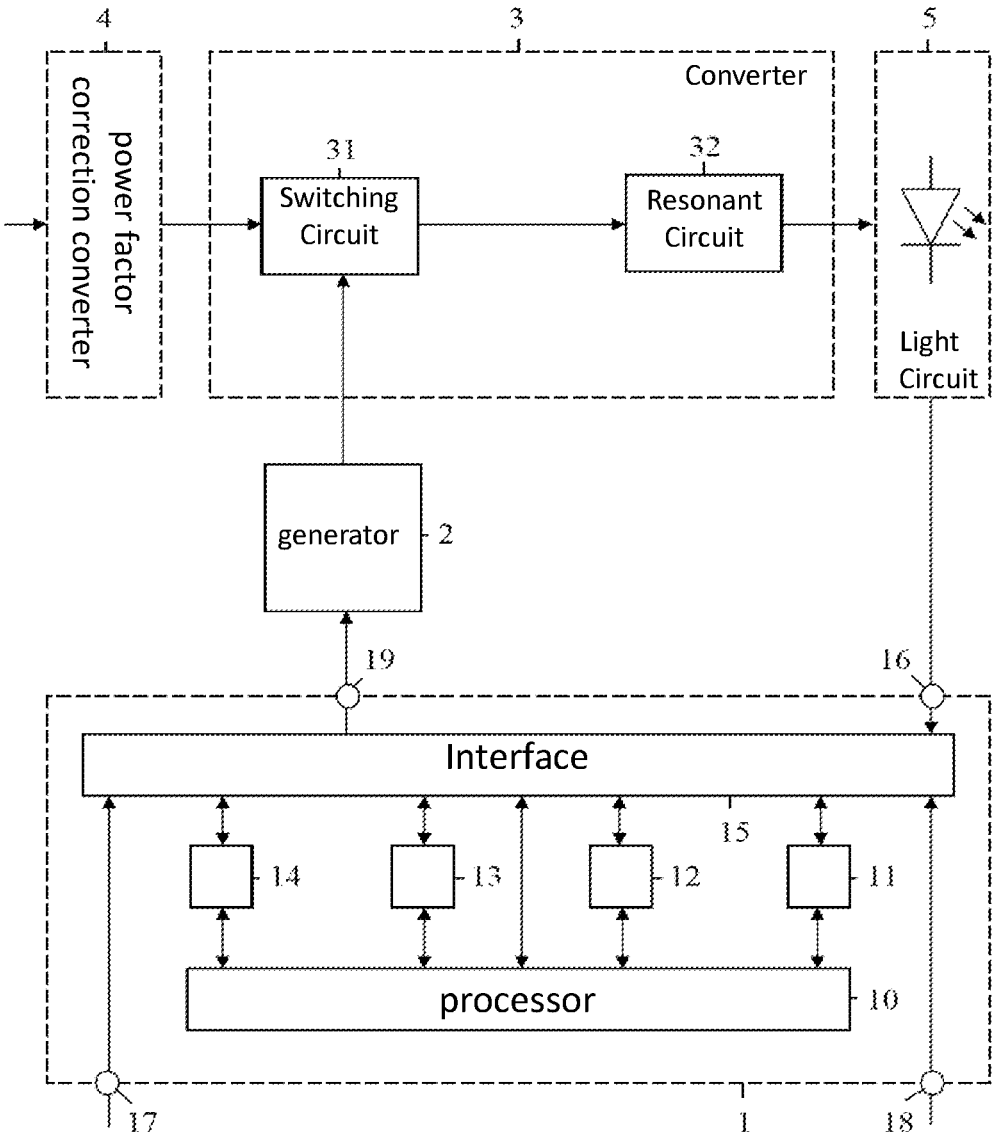
FIG. 1 shows an embodiment of a controller for controlling a generator arranged to generate a frequency signal for controlling a converter in a driver for driving a light circuit.

In the FIG. 1, an embodiment of a controller 1 is shown for controlling a generator 2 arranged to generate a frequency signal for controlling a converter 3 in a driver for driving a light circuit 5. An input of the generator 2 such as for example an actuator etc. for producing a frequency signal in the form of a square wave having a varying frequency is coupled to an output 19 of the controller 1. An output of the generator 2 is coupled to a control input of a switching circuit 31 such as for example a half-bridge or a full-bridge etc. An input of the switching circuit 31 is coupled to an output of an optional power factor correction converter 4. An input of the optional power factor correction converter 4 is for example coupled to a mains supply. An output of the switching circuit 31 is coupled to an input of a resonant circuit 32 such as for example a LLC circuit or a LCL circuit or a CLC circuit etc. An output of the resonant circuit 32 is coupled to an input of a light circuit 5 that for example comprises one or more light emitting diodes of whatever kind and in whatever combination. The switching circuit 31 and the resonant circuit 32 together form a converter 3 such as for example a resonant converter 3 etc.

An input 16 of the controller 1 receives feed-back information from the light circuit 5, such as for example a value of a feed-back signal such as for example a current signal flowing through at least a part of the light circuit 5. Such a current signal may flow through the entire light circuit 5 or may flow through one of two parallel parts of the light circuit and then further on be multiplied by two (in case both parts are similar parts) or may flow through one of three parallel parts of the light circuit 5 and then further on be multiplied by three (in case the three parts are similar parts) etc. Alternatively, the feed-back information may comprise a value of a feed-back signal defining a light intensity of at least a part of the light circuit 5 etc. An input 17 of the controller receives data information comprising a code for coding light produced by the light circuit 5. An input 18 of the controller 1 receives user information such as for example a reference value etc. such as for example a reference current value or a reference voltage value etc. defining a light intensity of the light produced by the light circuit 5 as chosen by a user.

The controller comprises an interface 15 coupled to and controlled by a processor 10 for interfacing the inputs 16-18 and the output 19 and the processor 10 and first to fourth parts 11-14. The first to fourth parts 11-14 are also controlled by the processor 10. The first part 11 of the controller 1 produces in response to the feed-back information from the light circuit 5 as arrived via the input 16 a control signal for controlling the generator 2. This control signal for example defines a frequency of the frequency signal produced by the generator 2 and destined for the switching circuit 31. A second part 12 of the controller 1 adapts the control signal in response to the data information as arrived via the input 17.

A third part 13 of the controller 1 determines a static transfer of a combination of the converter 3 and the light circuit 5 defined by values of the feed-back signal and corresponding values of the frequency of the frequency signal. Thereto, the third part 13 for example makes a table wherein each determined value of the feed-back signal is linked to a corresponding value of the frequency of the frequency signal. Usually, a larger (smaller) value of the frequency of the frequency signal will result in a smaller (larger) value of the current signal.

Preferably, the first part 11 is able to compare the value of the feed-back signal with the reference value as arrived via the input 18 and to adapt the control signal in response to a comparison result. In case the value of the feed-back signal is smaller (larger) than the reference value, the frequency of the frequency signal should be decreased (increased). This way, a light intensity of the light from the light circuit 5 can be regulated and/or fluctuations of the light intensity can be compensated.

Preferably, the second part 12 is able to adapt the control signal in response to the data information as arrived via the input 17 at the hand of the static transfer. Thereto, for a given light intensity of the light as for example expressed in a value of the feed-back signal, the data information will define whether this light intensity is to be increased or decreased. A modulation depth will define how much the light intensity is to be increased or decreased. The second part 12 can look up via the third part 13 or request the third part 13 how much the frequency of the frequency signal is to be increased or decreased to realize said modulation depth.

A fourth part 14 of the controller 1 defines a default transfer of the combination of the converter 3 and the light circuit 5. A default transfer allows the controller 1 to be started without a (complete) static transfer being present. Preferably, the controller 1 is a self-learning-controller arranged to start with the default transfer and to create the static transfer in operation. A self-learning-controller can be used for different loads and/or in different environments.

Preferably, the corresponding values of the frequency of the frequency signal form a first axis such as for example an x-axis, the values of the feed-back signal form a second axis such as for example a y-axis, and the third part 13 is arranged to divide the values of the feed-back signal into intervals of a substantially equal size. At a modulation depth of for example x %, it may be useful to divide the values of the feed-back signals into 100/x intervals (10% modulation depth→ten intervals, 5% modulation depth→twenty intervals) or pluralities thereof (10% modulation depth→10·y intervals, 5% modulation depth→20·y intervals, y=1, 2, 3 etc.). In that case, coding the light will correspond with shifting one interval or y intervals and looking up the corresponding frequency of the frequency signal.

Figure 2:
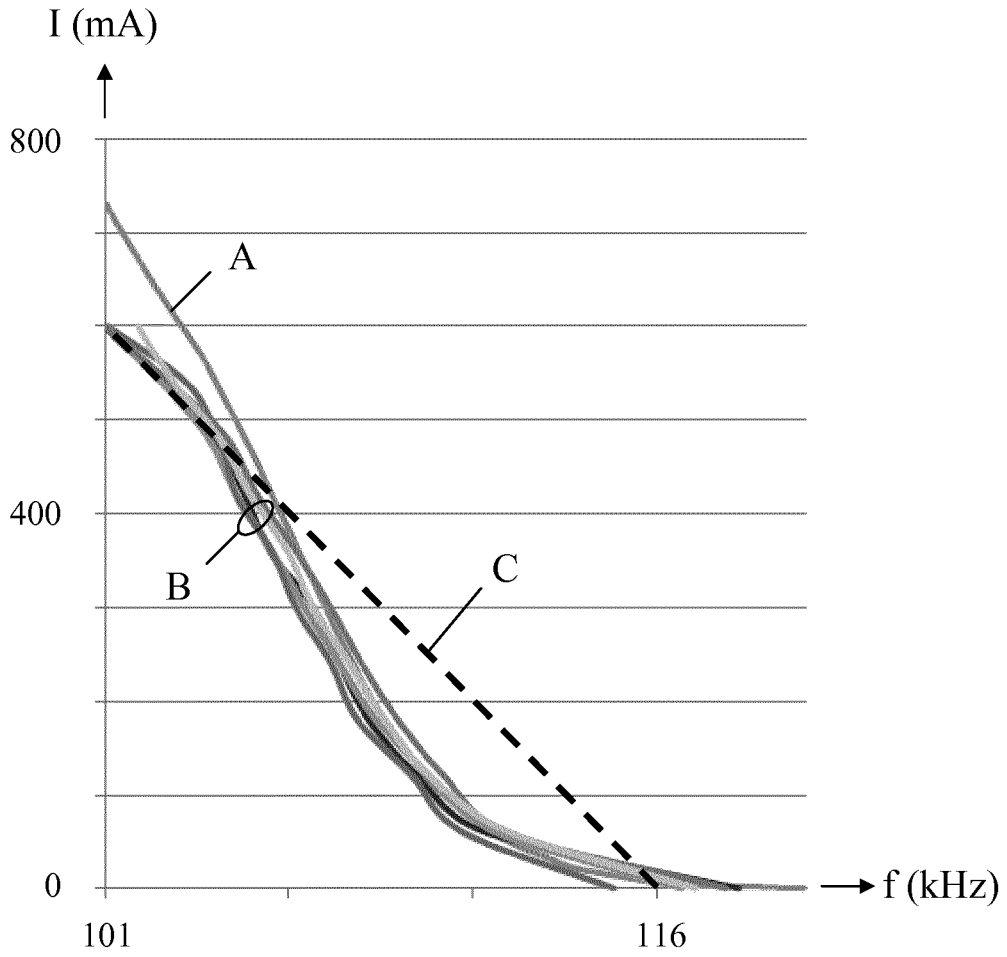
FIG. 2 shows a reference static transfer and experimental static transfers as measured and a default transfer.

In the FIG. 2, a reference static transfer A and experimental static transfers B and a default transfer C are shown. Each one of the transfers A, B and C links the values of the frequency of the frequency signal at the x-axis in kHz (101-116 kHz) and the values of the feed-back signal (here in the form of the current signal flowing through at least a part of the light circuit 5) at the y-axis in mA (0-800 mA). The reference static transfer A is for example a static transfer in an open-loop situation. In an open-loop situation, there is no feed-back and the controller 1 does not have any influence. The experimental static transfers B are for example experimentally determined static transfers. The experimental static transfers B differ from the reference static transfer A owing to the fact that a protection mechanism in the controller 1 becomes active when a current signal flowing through the light circuit 5 has reached a certain value. The default transfer C is for example a (by the fourth part 14) predefined transfer that allows the controller 1 to be started without a (complete) static transfer being present. The default transfer C may be an adaptable default transfer for adapting the controller 1 to a different load and/or to a different environment.

Clearly, the static transfers A and B are not linear. In different operating points defined by f in kHz and I in mA, a fixed frequency step Δf will result in different current steps ΔI. Coded light however requires, for a given modulation depth, that ΔI is relatively constant over an entire frequency range. Thereto, in each operating point, a frequency step Δf or a new frequency f is to be determined at the hand of the static transfer such that ΔI has a relatively same value as in the other operating points. Thereto, it might be interesting to let the third part 13 divide the values of the feed-back signal into intervals of a substantially equal size such that per operating point the frequency step Δf or the new frequency f is found by, for a given value of I, going up or down a fixed number of intervals and looking up the new frequency f. Preferably, by choosing a number of intervals equal to y·100/x with x being a modulation depth in %, the fixed number of intervals is equal to y intervals, with y=1, 2, 3 etc.

An operating point may be situated between the borderlines of an interval, in which case a borderline situated nearest to the operating point may be chosen as a starting point for going up or down the y intervals etc. A higher value for y will result in an increased preciseness and an increased use of controller resources.

Figure 3:
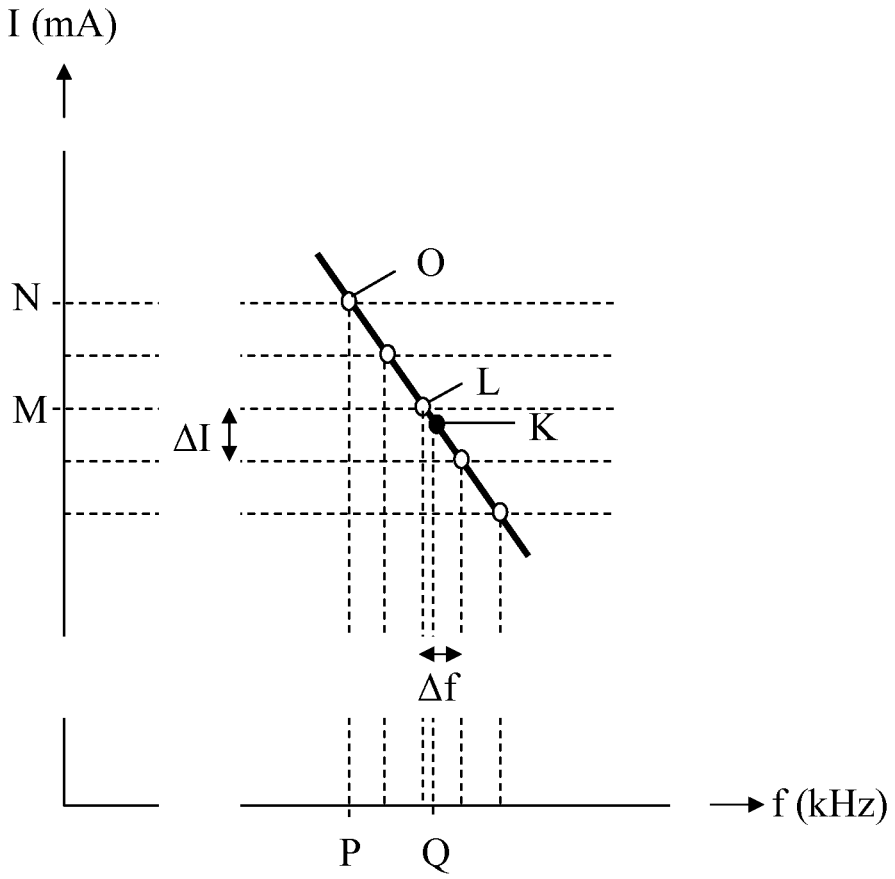
FIG. 3 shows a part of an experimental static transfer.

In the FIG. 3, a part of an experimental static transfer is shown. A combination of the converter 3 and the light circuit 5 is operative in an operating point K. Via the data information, a request arrives to make a positive pulse in the light intensity of the light circuit 5. A nearest borderline L of an interval ΔI comprising the operating point K is determined. This borderline L corresponds with a current value M. In this exemplary case, y=2, so to get the positive pulse the value M is to be increased by y=2 intervals, resulting in the current value N. The current value N corresponds with a borderline O, that corresponds with a frequency value P. So, to realize the positive pulse in the light intensity of the light circuit 5, the frequency is to be (shortly) reduced from a frequency value Q that corresponds with the operating point K to the frequency value P. By having introduced the intervals ΔI of a substantially equal size, a required processing capacity is reduced much.

A driver may for example comprise the resonant converter 3 for producing an output current signal or feeding signal for feeding the light circuit 5 and including or excluding the generator 2 and including or excluding the controller 1 and may further optionally comprise the power factor correction converter 4 for receiving an input voltage signal and producing an output voltage signal destined for the resonant converter 3.

Other kinds of converters 3 and 4 are not to be excluded. The generator 2 may alternatively form part of the controller 1 or of the converter 3. The first to fourth parts 11-14 may alternatively form part of the processor 10, or the processor 10 may alternatively form part of one or more of the first to fourth parts 11-14. The interface 15 may be left out if not required for example in case the processor 10 and/or the first to fourth parts 11-14 can communicate directly with the inputs 16-18 and the output 19. The interface 15 may alternatively form part of the processor 10 and/or of the first to fourth parts 11-14. The control signal may define a frequency of the frequency signal directly via a direct relationship or indirectly via a conversion. Both definitions may take place in an analog domain or in a digital domain. The processor 10 may operate at a clock-speed of for example 1 kHz or 6 kHz and the code may have a symbol-rate of 2400 Baud or 4000 Baud without having excluded other clock-speeds and other symbol-rates. In case the light is to be coded by manipulating the feed-back information, the clock-speed would need to be chosen disadvantageously higher. As a result of the fact that the light is coded by manipulating the control signal, the clock-speed can stay advantageously low, which is another great advantage.

Summarizing, controllers 1 control generators 2 arranged to generate frequency signals for controlling converters 3 in drivers for driving light circuits 5. The controllers comprise first parts 11 for in response to feed-back information from the light circuits 5 produce control signals arranged to control the generators 2 and second parts 12 for in response to data information adapting the control signals. The data information comprises codes for coding light produced by the light circuits 5. The feed-back information may comprise values of feed-back signals flowing through the light circuits 5 or defining light intensities of the light circuits 5. The control signals may define frequencies of the frequency signals. Third parts 13 may determine a static transfer of converter-light circuit-combinations defined by values of the feed-back signals and corresponding values of the frequencies. The corresponding values of the frequencies may form a first axis, the values of the feed-back signals may form a second axis. Fourth parts 14 may define default transfers of the combinations. The controllers 1 may be self-learning-controllers.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A controller for controlling a generator arranged to generate a frequency signal for controlling a converter in a driver for driving a light circuit, the controller comprising at least one input for receiving feed-back information from the light circuit, at least one output and a processor;

the processor configured to:

produce, in response to the feed-back information from the light circuit, a control signal arranged to control the generator, the feed-back information comprising a value of a feed-back signal that flows through at least a part of the light circuit or that defines a light intensity of at least a part of the light circuit, and the control signal defining a frequency of the frequency signal, adapt, in response to data information, the control signal, wherein the data information comprises a code for coding light produced by the light circuit;

determine a static transfer of a combination of the converter and the light circuit defined by values of the feed-back signal and corresponding values of the frequency of the frequency signal, the corresponding values of the frequency of the frequency signal being situated on a first axis, the values of the feed-back signal being situated on a second axis;

divide the values of the feed-back signal into intervals of a substantially equal size; and adapt the control signal in interval steps.

2. The controller as defined in claim 1, wherein the controller configured to compare the value of the feed-back signal with a reference value and to adapt the control signal in response to a comparison result.

3. The controller as defined in claim 1, wherein the controller is configured to define a default transfer of the combination of the converter and the light circuit.

4. The controller as defined in claim 3, the generator comprising an actuator for producing the frequency signal in the form of a square wave having a varying frequency.

5. The controller as defined in claim 3, the converter comprising a resonant converter for producing an output current signal destined for the light circuit.

6. The controller as defined in claim 5, further comprising a power factor correction converter for receiving an input voltage signal and producing an output voltage signal destined for the resonant converter.

7. The controller as defined in claim 1, the controller being a self-learning-controller arranged to start with the default transfer and to create the static transfer in operation.

8. The controller as defined in claim 1, wherein the light circuit includes one or more light emitting diodes.

9. A method for controlling a generator arranged to generate a frequency signal for controlling a converter in a driver for driving a light circuit, the method comprising the steps of:

in response to feed-back information from the light circuit, producing a control signal arranged to control the generator, the feed-back information comprising a value of a feed-back signal that flows through at least a part of the light circuit or that defines a light intensity of at least a part of the light circuit, and the control signal defining a frequency of a frequency signal;

in response to data information adapting the control signal, and wherein the data information comprises a code for coding light produced by the light circuit;

determining a static transfer of a combination of the converter and the light circuit defined by values of the feed-back signal and corresponding values of the frequency of the frequency signal, the corresponding values of the frequency of the frequency signal being situated on a first axis, the values of the feed-back signal being situated on a second axis;

dividing the values of the feed-back signal into intervals of a substantially equal size; and adapting the control signal in interval steps.

10. A non-transitory computer readable medium comprising a computer readable program for controlling a generator arranged to generate a frequency signal for controlling a converter in a driver for driving a light circuit when executed on a computer cause the computer to perform the steps of:

in response to feed-back information from the light circuit, producing a control signal arranged to control the generator, the feed-back information comprising a value of a feed-back signal that flows through at least a part of the light circuit or that defines a light intensity of at least a part of the light circuit, and the control signal defining a frequency of a frequency signal, in response to data information adapting the control signal, and wherein the data information comprises a code for coding light produced by the light circuit;

determining a static transfer of a combination of the converter and the light circuit defined by values of the feed-back signal and corresponding values of the frequency of the frequency signal, the corresponding values of the frequency of the frequency signal being situated on a first axis, the values of the feed-back signal being situated on a second axis;

dividing the values of the feed-back signal into intervals of a substantially equal size; and adapting the control signal in interval steps.

* * * * *